United States Patent [19]

Counsel

[11] Patent Number: 4,600,264

[45] Date of Patent: Jul. 15, 1986

[54] ELECTRIC TAP CONNECTOR

[75] Inventor: Eugene F. Counsel, Clearwater, Fla.

[73] Assignee: UTM Power Products, Inc., Tampa, Fla.

[21] Appl. No.: 691,915

[22] Filed: Jan. 16, 1985

[51] Int. Cl.[4] ..... H01R 13/24

[52] U.S. Cl. ..... 339/247; 339/249 R; 339/263 L; 339/270 R

[58] Field of Search ..... 339/270, 273, 245–247

[56] References Cited

U.S. PATENT DOCUMENTS

| | | | |
|---|---|---|---|
| 2,233,216 | 2/1941 | Matthysse | 339/270 R |
| 2,445,772 | 7/1948 | Frese | 339/270 R |
| 2,547,176 | 4/1951 | Salmons | 339/270 R |
| 3,491,331 | 1/1970 | Glader | 339/270 R |
| 4,027,939 | 6/1977 | White | 339/270 R |
| 4,279,461 | 7/1981 | Bussen et al. | 339/270 R |
| 4,415,222 | 11/1983 | Polidori | 339/270 R |

FOREIGN PATENT DOCUMENTS

| | | | |
|---|---|---|---|
| 403660 | 10/1924 | Fed. Rep. of Germany | 339/270 R |

*Primary Examiner*—Gil Weidenfeld

*Assistant Examiner*—David L. Pirlot

*Attorney, Agent, or Firm*—Frijouf, Rust & Pyle

[57] ABSTRACT

A simplified, low-cost connector assembly for attaching tap lines to overhead electrical main or tap conductors is provided which eliminates potential damage to the connected lines by provision of a cable-receiving housing and a complemental line-wedging block received therein along with means for gradually drawing the block into operative wedging position so as to preclude line damage. The assembly hereof preferably includes a tapered, generally transversely C-shaped, line-receiving housing, in conjunction with a complementally tapered wedge block and bolt means for gradually drawing the block into tight, line-connecting engagement with the respective cable sections received with the C-shaped housing. A reverse drive is provided by a laterally slotted lug on the wedge, the head of the bolt means and a lock nut providing forward and reverse drive with the lug. Torque limiting is accomplished by a replaceable frangible drive adaptor on the bolt head. The wedge is self-centering for bedding into the assembly with distributed forces.

4 Claims, 10 Drawing Figures

ELECTRIC TAP CONNECTOR

BACKGROUND OF THE INVENTION

Field of the Invention

This invention is an electrical connector and more particularly an electrical tap connector for electrically and mechanically connecting an electrical tap conductor to a main conductor. The tap conductor can take at least two forms. One form is a cable. The other is a bail to which local tap connectors may be attached and removed periodically without disturbing the main connector and further enabling the tap connection to be made while the cable is carrying a high potential voltage, a situation described as "hot".

A number of connector assemblies have been proposed and made available to the market place for connecting tap conductors or tap lines to overhead electrical main conductors. One such assembly is taught in U.S. Pat. No. 4,027,939, issued to one Thomas White. The White patent shows a connector comprising generally a C-shaped housing wherein the main conductor is intended to be positioned in the upper part of the housing and the tap conductor in the lower part of the housing. A tapered wedge block is manually positioned between the main and tap conductors and is then forced into the housing, which wedges the conductors away from each other and against the upper and lower walls of the C-shaped housing.

Probably the most significant disadvantage of the White device is that there is no way for conveniently removing the wedge block if it is ever desired to disconnect the conductors. Although there are tools available for working with hot main lines, the insertion of the wedge by such tools can be very difficult.

A similar connector is disclosed by Kelly U.S. Pat. No. 1,801,277 which is cited as prior art in White.

U.S. Pat. No. 4,114,977 assigned to the assignee of the present applicants, teaches a convenient means of fastening a main and tap conductor in a cross-grid position, but again lacks the capability of convenient disassembly and does require insertion of a separate wedge piece.

U.S. Pat. No. 3,544,956 provides an electrical connector which includes a feature allowing the conductor engaging members to be withdrawn from the conductor for disassembly. Again, however, this prior art teaching is a device which cannot be installed with one hand and is quite complex in that it requires two different screw devices for separately securing conductors.

Although there are other connectors both patented and unpatented in the background of the present invention, sufficient understanding of the field will be obtained by referring to U.S. Pat. No. 4,415,222 issued to Mario Polidori. The Polidori device includes a C-shaped body having a curved top wall adapted to fit over a main conductor. A screw-operated wedge is carried by the bottom of the C-shaped body. A separate conductor interface insert has a handle which allows the conductor interface to be placed within the connector body between the connectors.

The Polidori U.S. Pat. No. 4,415,222 enables a wedge to be moved both in and out so that the clamping action of the connector can be tightened or loosened as desired. The device also includes a frangible nut configuration as an integral part of the system to prevent overtightening of the screw. Although shear devices are old and well known it is possible that U.S. Pat. No. 4,415,222 is the first to employ such a device in a electrical connector environment.

SUMMARY OF THE INVENTION

The foregoing "background" has highlighted the products believed to be most nearly similar to the present invention, and some of the features which this invention seeks to be improved upon.

The electrical connector of this invention is highly suited to electrically and mechanically connect a main conductor to a tap conductor. The tap conductor can be another main line or a bail to which tap lines may be readily attached and detached, even while the circuit is "hot".

The invention includes a C-shaped body having a curved top wall adapted to hook over a main conductor.

The body has a curved bottom wall substantially identical to the top curved wall adapted to receive the tap conductor or bail.

A separate wedge is engaged with a captive drive screw. The captive nature is provided by a lateral slotted lug. The screw and lug are laterally shiftable with respect to one another in order to allow the wedge to be free floating. The screw is captive longitudinally and drives in either direction, to drive the wedge forward or in reverse direction.

The preferred embodiment includes a "hot" stick tab. The tap connector per se does not have a torque limiting structure, such as the shear device structure of the prior art. Rather, by providing a frangible drive adapter designed to fracture at a given torque level, this invention assures the user that sufficient wedging force has been applied to properly set the wedge. The danger in prior art devices is that not enough pressure may be applied. This invention provides a replaceable frangible adaptor that is driven until it fractures. Only then is the operator sure the wedge is seated properly. Thus, expensive shear devices on the connector itself are eliminated, and the structure is reusable without reconstruction.

THE PREFERRED EMBODIMENT

Figure 5:
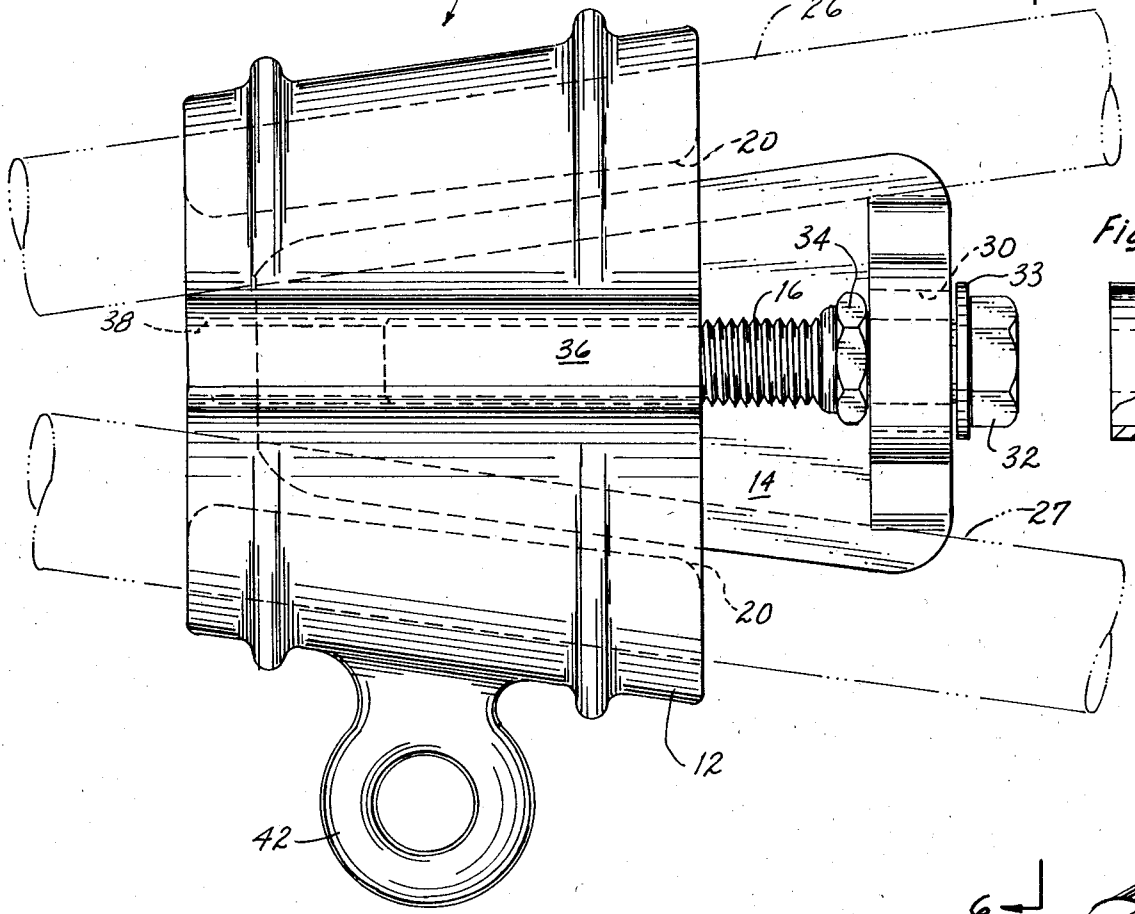
FIG. 5 is a side elevational view of the assembly of body and wedge as an operative tap wire connector.
Figure 10:
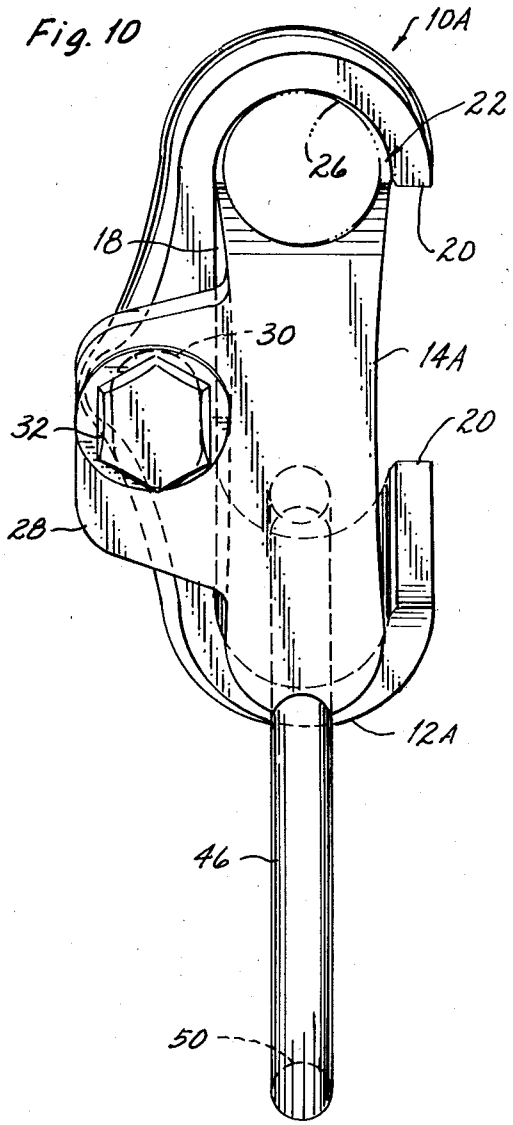
FIG. 10 is an end view taken along line 10—10 of FIG. 9.
Figure 9:
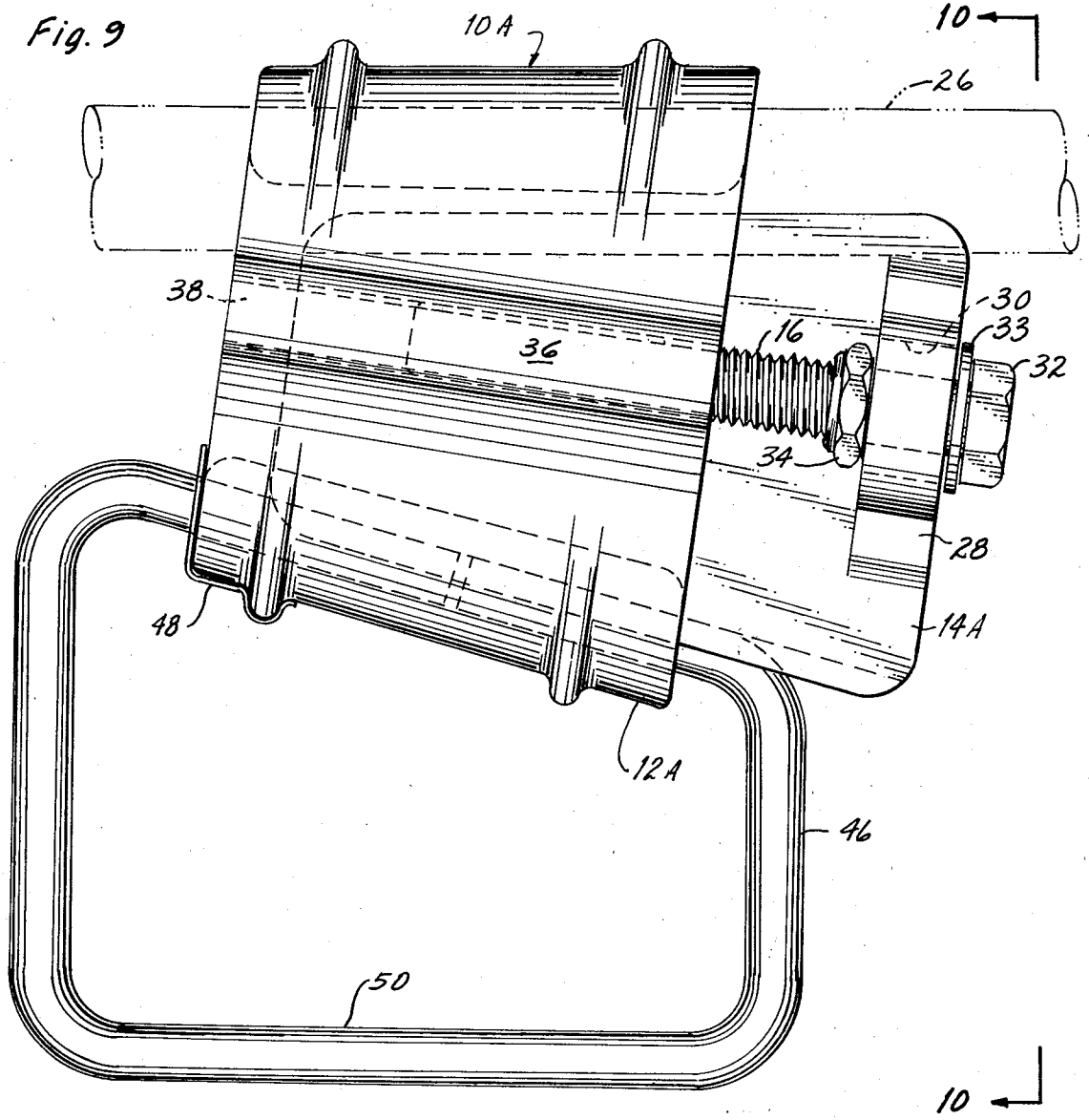
FIG. 9 is a side elevational view of a basic body structure without a hot stick tab as shown in FIG. 5, and illustrating a bail conductor supported by the structure.

FIGS. 1–4 are the parts of the improved device of this invention, whereas FIG. 5 illustrates the assembly of the parts. The connector assembly 10 in accordance with the invention broadly includes an elongated, longitudinally tapered, generally transverse C-shaped, open-ended housing body 12. In FIG. 5 the assembly is indicated by reference character 10 and an alternative structure 10A is illustrated in FIG. 9.

A complementary wedge block 14 configured for reception in housing body 12 is advanced and retracted by a screw drive 16. The housing body 12 carries a ridge or raised welt 36 along the center line of the housing body, and the ridge or raised welt 36 is formed with a threaded bore 38 which extends along the center line of the housing body for accepting the screw drive 16. The preferred embodiment of housing body 12 is illustrated best in FIG. 2. The body 12 is symmetrical about 2 planes. The hook portions 22 are arcuate and symmetrical about a plane common to both hook portions. The center line of bore 38 lies along a plane which is perpendicular to the plane of the hook portions. The intersections of the planes defines a center line of the housing body. The bore 38 is positioned lateral to the center line of the housing body and parallel thereto.

Figure 1:
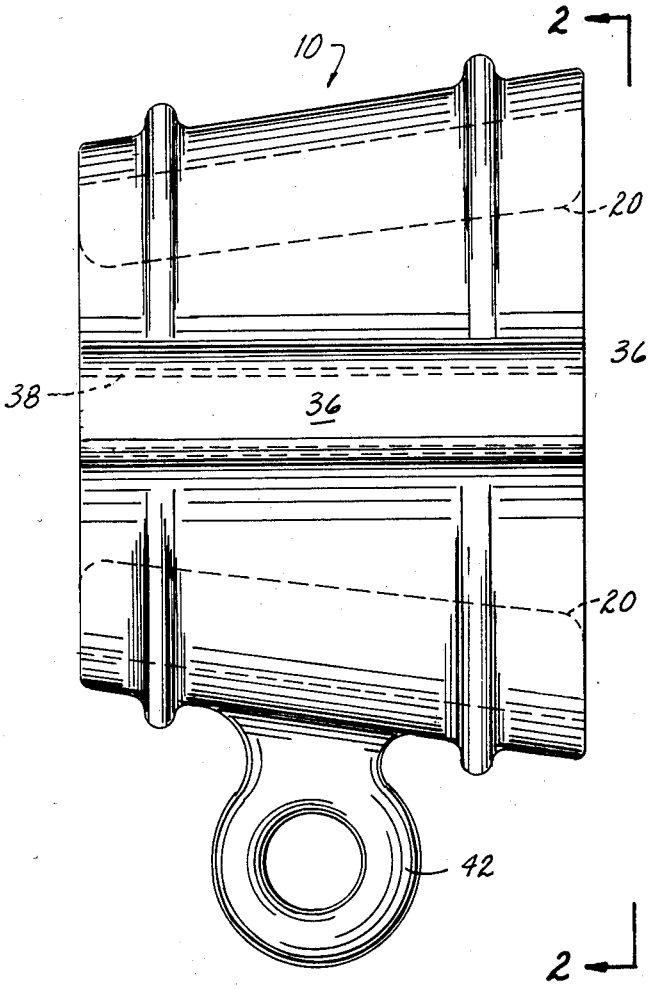
FIG. 1 is a side elevational view of a tap connector body of this invention, with a hot stick tab included.
Figure 2:
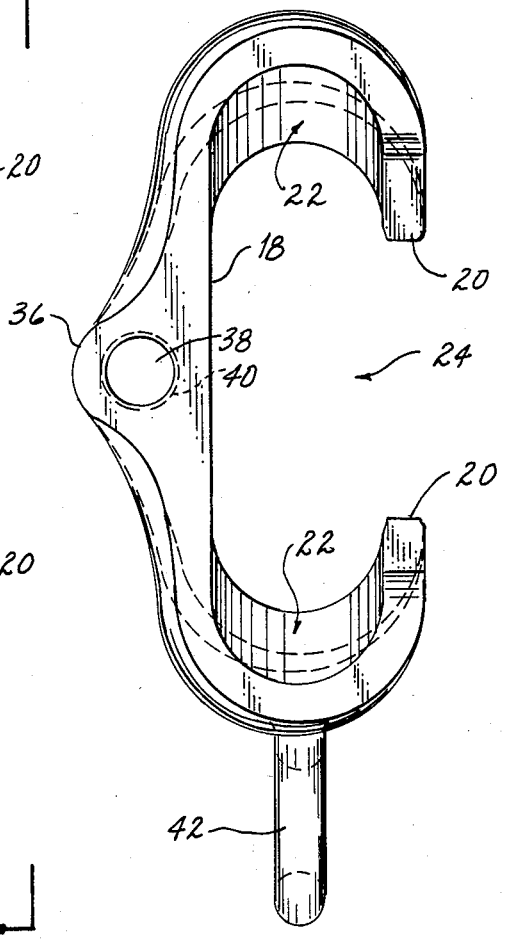
FIG. 2 is an end view of the FIG. 1 embodiment as viewed along 2—2 of FIG. 1.
Figure 4:
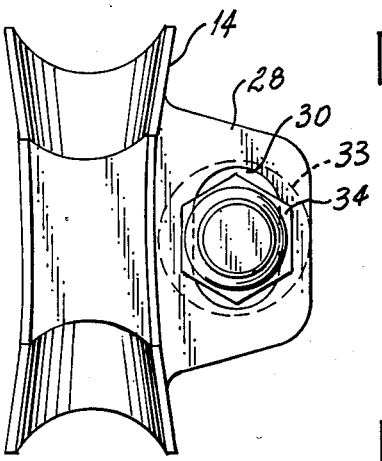
FIG. 4 is an end view of the FIG. 3 wedge as viewed along line 4—4 of FIG. 3.
Figure 3:
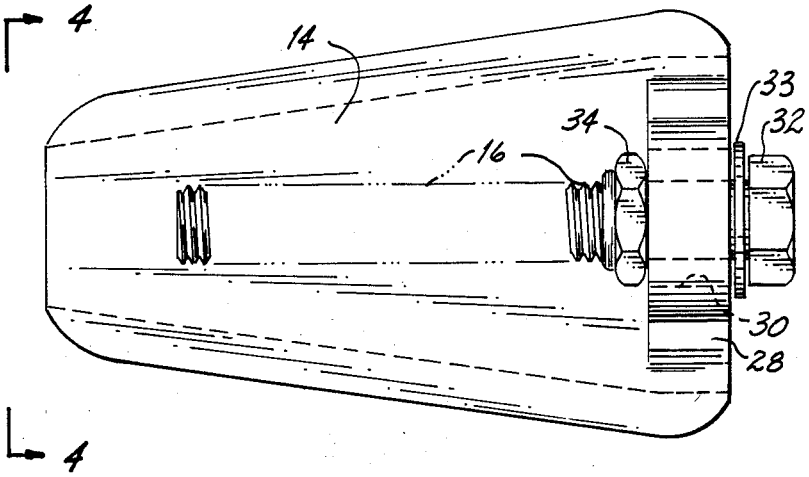
FIG. 3 is a top plan of an insert wedge used in cooperation with the body of FIGS. 1 and 2.
Figure 6:
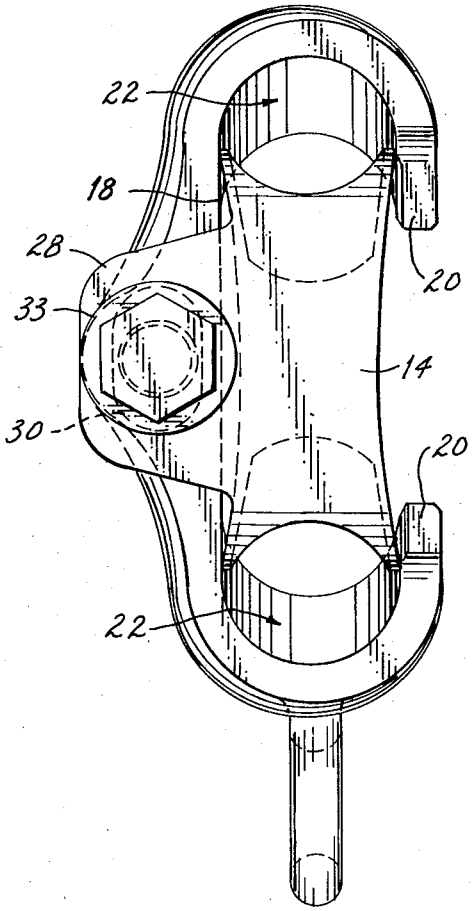
FIG. 6 is an end view of the FIG. 5 assembly as viewed along 6—6 of FIG. 5.
Figure 7:
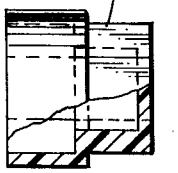
FIG. 7 is a side elevation, partially broken away, of a frangible torque limiter.
Figure 8:
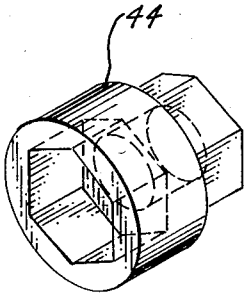
FIG. 8 is a perspective view of the torque limiter.

In more detail, housing body 12, as best seen in FIGS. 1 and 2, includes a back portion 18 and a pair of spaced, opposed generally arcuate upper and lower hook portions 20. The back portion 18 is not necessarily a continuous solid or planar structure, but manufacturing techniques suggest that the integral structure illustrated is economically preferred. The main purpose of the back portion 18 is to position and firmly secure the hook portions 20 in their relative tapered relationship.

The hook portions 20 each defines a line receiving nest area 22 to accept the generally cylindrical main lines employed in electrical systems. The back portion 18 and the hook portions 20 cooperatively present an open front wedge block receiving area 24.

The top hook portion 20 is designed to hang upon a main line. Such a main line is suggested by a dotted outline and by reference character 26. A branch tap line, shown in phantom in FIG. 5 and indicated by reference 27, is nested into the area 22 of the lower portion. Due to the angular relationship of the nest portions 22, the main and tap or branch lines will then define an angular space therebetween. The wedge block 14 is tapered at the same angle as the angular relationship of the hook portions 20 and therefore will fit between the main and tap lines 26 and 27 in mating relationship.

As thus described, the wedge could be driven into the space between the main and tap lines to wedge the lines into the housing body 12 for both good mechanical and electrical interconnection, as suggested by U.S. Pat. No. 3,065,449.

There are two disadvantages in stopping the construction at the point of requiring the wedge block 14 to be externally hammered into position. First, such assembly is difficult to be installed on an electrically "hot" line for obvious reasons. Secondly, such a driven wedge cannot be conveniently removed and particularly not while the line is hot.

The prior art, particularly the Polidori construction of U.S. Pat. No. 4,415,222 teaches a good, but expensive, means for driving such a clamping wedge into and out of engagement and may be employed on both hot and dead lines. This invention provides a new and improved structure which is far less expensive than the prior art devices and is submitted as being highly reliable as a result of its simplicity of its structure.

After much design work and testing, it was determined that a superior holding function is obtained by allowing the wedge block 14 to seek its own bedding relationship to the housing body rather than to dictate a fixed path of travel. Accordingly, wedge block 14 is provided with lateral lug 28 which is defined by Webster's New 20th Century Dictionary as being an "ear, or anything projecting or hanging like the ear or its lobe, as a block for keeping a slide in place."

Lug 28 is then provided with a lateral slot 30 through which the screw drive 16 may extend. Slot 30 has a minor and major axis. The major axis, when lug 28 is placed into body 12, is substantially parallel to the bisecting plane of the hooks 20. The screw drive is literally a threaded bolt having a head 32. A washer 33 is preferably employed to prevent any tendency of head 32 to wedge into the slot 30. The stem of the screw drive 16 is passed through the slot 30 and a lock nut 34 is threaded up to the side of the lug opposite head 32. Lock nut 34 is preferably a self locking type such a nylon insert lock nut sold by Greer Company, Smyrna, Tenn. The lock nut 34 stops short of a tight engagement. This combination of head 32 and lock nut 34 provides spaced annular flange members which capture the lug. There is some play allowed for freedom of lateral movement of the wedge block 14 with respect to the screw drive 16.

The wedge block 14 is assembled into the housing body 12 to complete the connector assembly 10 by projecting the screw drive bolt into the bore 38 and turning the screw drive a sufficient number of turns to securely engage the screw drive into the threaded portion 40.

As thus described, the completed connector assembly 10 may be engaged with a main line 26 by hooking one of the hook portions 20 over the line 26. There is sufficient space between the loosely assembled wedge block 14 and either of the hook portions 20 to permit the assembly to be hooked over such main cable.

Then, a branch cable 27 is placed between the wedge and the opposite hook portion 20 and the wedge block 14 advanced into the housing body 12 by rotation of the screw drive 16. Wedge block will self-center because of the slotted lug construction. The main and tap cables 26 and 27 are therefore progressively wedged into tight mechanical and good electrical contact with the housing body 12 to provide the mechanical and electrical main qualities required by proper electrical code.

There are many cable connecting devices, at least 12 of which were examined during the prosecution of U.S. Pat. No. 4,415,222, including devices from Switzerland and the United Kingdom. Each of these devices are actually known to applicants, or have been examined for their theory of operation, and rejected because of cost, electrical or mechanical deficiencies, or requirement for elaborate precautions when assembling hot lines. Accordingly, this invention is embodied in the environment of the connector assembly for electrically and mechanically joining main and tap conductors, wherein there is a housing body defining opposed angularly converging line receiving nest areas, and a wedge block positioned within the housing body. The wedge block complementarily configured with the angularly converging line receiving nest areas for tightly wedging cable conductors into the housing body. This improvement comprises a screw drive threadably interconnected to the housing body and extending substantially along a center line plane of the nest areas and a floating interface interconnection between the screw drive and the wedge block, the interference interconnection characterized by a lug portion on said wedge block and spaced flange members carried by the screw drive. The interface interconnection lug portion and spaced flange members are further characterized by a freedom of the screw drive and lug portion to shift laterally but not longitudinally whereby the wedge block is driven in forward or reverse direction in response to rotational drive of the screw drive, and the wedge is nevertheless free to find its natural bedding relationship to the housing body.

As a further refinement of this invention, a tab 42 is provided in one embodiment of the invention as shown in FIGS. 1 and 5. Tab 42 is provided for convenience of attachment of hot line tools such as a clamp stick by A. B. Chance Company of Centralia, MO, U.S., and tap equipment such as manufactured and sold by Fargo Manufacturing Company, Inc. of Poughkeepsie, N.Y. The connector assembly 10 is thus capable of being held firmly in position by the lineman but insulated from that workman to prevent electrocution. Because of the improved forward and rear drive to tighten and remove the wedge block 14, other hot line tools of simple nature are capable of being used to complete the assembly or disassembly of hot lines.

Furthermore, it is necessary that the wedge is sufficiently tightened to its optimum electrical conduction and mechanical holding power. In the prior art, the drive is determined by shear connector devices. See U.S. Pat. No. 4,415,222 for an example. A standard item of commerce in the form of a plastic frangible adaptor 44 is used as a torque determiner in this invention. The frangible adaptor 44 is designed for that very purpose in various degrees of strength, for use in any environment where torque control is required. Thus, by the employment of the frangible adaptor 44, the present invention completely eliminates the costly, non-renewable shear device of the prior art. Adaptor 44 is available from "Guard Nut" Sonoma, Calif.

As an added feature of this invention, the structure enables a bail 46 to be placed in the assembly rather than a tap line 27. Minor tap circuits are connected to main conductors by means of such bail and enables the use of hot line taps to connect and disconnect local tap circuits without the danger of creating sparking and improper welding of the main conductor as a result of such sparking in the assembly proper. Thus, a hot line tap connected to the bail 16 may be connected and reconnected by suitable hot line tools. The bail is formed of a single piece, preferably bent with two parallel sides and two non-parallel sides. The ends of the bail are preferably resident within the hook 20 of the connector and the bail is held against escape by means of a simply clip 48. It is a distinct advantage of the use of such bail that the bail may swing in almost an infinite arcuate path to present an exposed run 50 suitably positioned for attachment of a hot line tap.

What is claimed:

1. In a connector assembly for electrically and mechanically joining main and tap conductors, wherein there is a housing body presenting opposed generally arcuate angularly converging line receiving hook portions defining nest areas, said hook portions facing one another and bisected by a common center line plane, and a wedge block positioned within said housing body, the wedge block complementarily configured with the angularly converging line receiving nest areas for tightly wedging main and tap conductors into the housing body, the improvement comprising:

body surfaces defining a threaded receiving bore having a longitudinal axis lying laterally of said centerline plane and lying in a plane which is perpendicular to said centerline plane at a center line of said body;

a screw drive threadably interconnected to said threaded bore;

a floating interface interconnection between the screw drive and the wedge block, said interface interconnection characterized by a lateral lug portion on said wedge block, said lug portion having a lateral slot defined by a major axis transverse of said center line plane and a minor axis, the distance across said slot at the minor axis being about the same as the diameter of the screw drive, the spaced flange members carried by the screw drive, said interface interconnection lug portion and spaced flange members being further characterized by a freedom of the screw drive and lug portion to shift laterally but not longitudinally; and whereby the wedge block is driven in forward or reverse directions in response to rotational drive of said screw drive, and the wedge is nevertheless free to find its natural bedding relationship to the housing body.

2. The improvement in connector assembly of claim 1, wherein the wedge block is provided with a lateral lug, and the screw drive is a bolt with spaced annular portions spanning the lug.

3. The improvement in connector assembly of claim 1, wherein the wedge block is provided with a lateral lug, a lateral opening through the lug, and the screw drive being a bolt extending through the lateral opening, said bolt having a section diameter less than the lateral opening length to provide for lateral shiftability of the wedge relative to the screw drive bolt.

4. The improvement in connector assembly of claim 1, wherein the wedge block has a slotted lateral lug, and the screw drive is a standard machine bolt with the stem extending through the slot to position the bolt head on one side of the lug, and a self locking nut positioned on the side of the lug opposite the bolt head, to enable drive transmission in forward or reverse threaded drive of the bolt.

* * * * *